US006354488B1

(12) United States Patent
Gallagher

(10) Patent No.: US 6,354,488 B1
(45) Date of Patent: Mar. 12, 2002

(54) SECONDARY SEAL FOR FLOATING ROOF STORAGE TANK

(75) Inventor: Terry A. Gallagher, Wheaton, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 0 days.

(21) Appl. No.: 09/630,059

(22) Filed: Aug. 1, 2000

(51) Int. Cl.[7] ..... B65D 88/46; B65D 88/50

(52) U.S. Cl. ..... 230/221; 220/224; 220/225; 220/226

(58) Field of Search ..... 220/214, 221, 220/222, 224, 225, 226, 228, 232, 216

(56) References Cited

U.S. PATENT DOCUMENTS 2,287,211 A * 6/1942 Wiggins
2,523,292 A * 9/1950 Goldsby et al.
2,540,801 A * 2/1951 Wiggins
2,568,728 A * 9/1951 Goldsby et al.
3,422,981 A * 1/1969 McBrien et al.
4,126,243 A * 11/1978 Bruening ..... 220/224
4,308,968 A * 1/1982 Thiltgen et al. ..... 220/222
4,401,306 A * 8/1983 Arnold ..... 220/222
4,524,878 A * 6/1985 Imhof ..... 220/224
4,811,859 A * 3/1989 Kinghorn, Jr. ..... 220/224
6,247,607 B1 * 6/2001 King ..... 220/221

* cited by examiner

*Primary Examiner*—Nathan J. Newhouse
(74) *Attorney, Agent, or Firm*—Marshall, Gerstein, & Borun

(57) ABSTRACT

A low profile secondary seal has a tube positioned above a primary seal that utilizes a shoe plate. The tube is connected to the floating roof. A tip seal adjacent the shell of the tank is connected to the shoe plate by a spacer. In use, the tube bears on the spacer with sufficient force to maintain the tip seal in sealing engagement against the shell of the tank.

20 Claims, 5 Drawing Sheets

SECONDARY SEAL FOR FLOATING ROOF STORAGE TANK

BACKGROUND OF THE INVENTION

This invention relates generally to storage tanks having roofs that float on the surface of the stored product, and more particularly to secondary seals used in such tanks.

Floating roof tanks are widely used to store volatile petroleum-based liquids and limit the quantity of product evaporative emissions that may escape to the environment. Such tanks may be configured either as internal floating-roof tanks or as external floating-roof tanks. In each configuration, the floating roof is designed to remain in contact with the product liquid surface and cover all of the surface of the product except for a small annular surface area between the outermost rim of the floating roof and the inside surface of the tank shell. Product evaporative emissions from this area may be controlled by a single, primary seal. However, for increased effectiveness, emissions from this area are conventionally controlled by a combination of perimeter rim seals, including a primary seal with a secondary seal mounted in the rim space above it.

Primary seals conventionally take the form of a piece of fabric extending between the floating roof and a shoe plate that bears on the tank shell. Examples of such seals are illustrated in Wagoner, U.S. Pat. No. 5,036,995 and in Ford et al., U.S. Pat. No. 5,529,200. Alternatively, primary seals may be in the form of resilient liquid- or foam-filled seals that are supported from the floating roof.

Secondary seals for floating-roof tanks should span the distance between the floating-roof and the tank shell. Most conventional secondary seals are mounted to the floating roof and extend upwards across the rim space to contact the tank shell some vertical distance above the floating roof. The vertical distance represents a characteristic clearance requirement for the secondary seal.

One prevalent type of secondary seal includes metal compression plates that attach to the floating roof and support a tip seal against the tank shell, as disclosed in Kinghorn et al., U.S. Pat. No. 4,116,358; Grove et al., U.S. Pat. No. 4,615,458; and Thiltgen et al., U.S. Pat. No. 4,308,968. In each of these designs, the compression plates are mounted at an angle to the tank shell.

The angle of the compression plates is critical. If the angle is too steep, the tip seal can become jammed against the tank shell as the seal attempts to pass over weld seams or other surface irregularities on the tank shell. If the angle is too shallow, the tip seal can drag against the tank shell or catch on a weld seam or other shell discontinuity. Either event may cause the compression plates to fold into the rim space and damage one or more sections of the secondary seal, opening gaps between the tip seal and the tank shell that can lead to increased evaporative emissions to the atmosphere.

Further, as a floating roof drifts toward one section of the tank shell, the angle of the compression plates becomes more vertical, increasing the vertical clearance required to keep the tip seal inside the tank and in contact with the tank shell. For a typical storage tank with a nominal 8" rim space, the width of the rim space at any particular point may actually vary between about 4" to more than 12" as the roof moves, increasing the vertical clearance requirement to as much as 24". Tank size or tank foundation considerations may also dictate a 10-inch or even 12-inch nominal width for the rim space, with permissible variations as large as ±7 inches or more. Consequently, the vertical clearance requirement for a conventional secondary seals may sometimes exceed 31".

This vertical clearance requirement presents a problem both for new tanks and for retrofitting old tanks. New tanks must be designed with excess, unusable capacity to account for the required vertical clearance, adding to the construction cost. Similarly, when a secondary seal is added to an existing floating-roof tank, the maximum filling height of the tank may need to be reduced to accommodate the required vertical clearance for the secondary seal. Any such reduction of the maximum filling height represents lost inventory to the owner/operator of the tank. For example, when a secondary seal is added to an existing 100-foot (≈30 meter) diameter floating-roof tank, a nominal 2-foot (0.6 meter) reduction in filling height represents a loss of approximately 117,500 (2800 Bbl) of product storage. Such a loss can significantly reduce the revenue of the owner/operator of the tank.

It is believed that previous efforts to solve the problems associated with the vertical clearance requirement have not found commercial success. Hills et al., U.S. Pat. No. 104, 339,052, discloses a secondary seal in the form of a tube that is connected near the top of the floating roof. One problem with this arrangement is that the secondary seal can rotate upwards, out of the rim space as the floating roof descends during product send-out operations. Petri et al., U.S. Pat. No. 5,284,269, discloses a space-saving double-seal system comprised of two shoe segments mounted above each other. One problem with this arrangement is that the shoe supports of the primary seal extend beneath the floating roof, increasing the risk of interference with equipment inside the tank.

Because of these disadvantages in previously-disclosed low-profile secondary seals, it is believed that a need exists for a novel, low-profile secondary seal.

SUMMARY OF THE INVENTION

The present invention provides a useful, low-profile secondary seal that can be used with a conventional primary seal that utilizes a shoe plate. The secondary seal is positioned above the primary seal and comprises a resilient tube connected to the floating roof. A tip seal adjacent the shell of the tank and is connected to the shoe plate by a spacer. In use, the tube bears on the spacer with sufficient force to maintain the tip seal in sealing engagement against the shell of the tank.

In some embodiments of the invention, the tip seal may be no more than about twelve inches above the top of the floating roof. The spacer may be constructed in the form of a series of inwardly-projecting, overlapping plates. The tube may be attached to the shoes by a flap that extends from the tubular section. A protective cover may also be inserted between the shoe plate and the tube. Electrical shunts may extend from the tip seal to the floating roof, and from the tip seal to the shell.

BRIEF DESCRIPTION OF THE DRAWINGS

The invention may be better understood by reference to the accompanying drawings, in which.

DETAILED DESCRIPTION OF THE DRAWINGS

Figure 1:
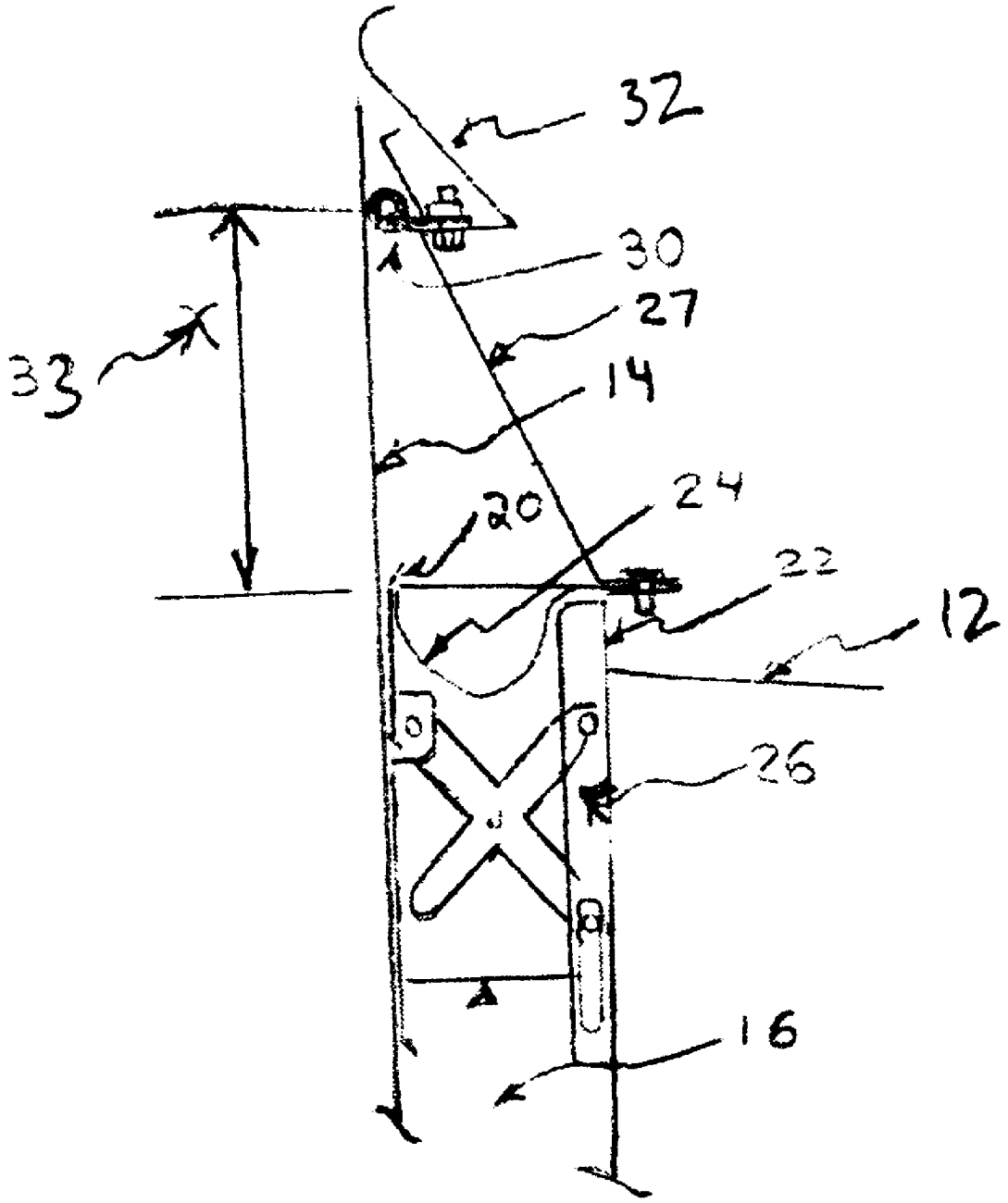
FIG. 1 PRIOR ART
FIG. 1 is an elevational view of a conventional, prior art secondary seal.

FIG. 1 illustrates a typical prior art secondary seal in an internal, floating-roof tank in which a floating roof 12 floats within a tank shell 14, leaving a rim space 16 between the roof and the shell. A fixed roof, spanning the entire tank or supported by columns, can also be added to create an internal floating-roof tank.

Multiple overlapping shoe plates 20 form a continuous seal against the inside surface of the tank shell 14. Each shoe plate is partially submerged in the stored product and extends above the product liquid surface to an elevation near that of the top of the floating roof 12. The rim space is substantially closed by a primary seal 24 that is connected directly to the upper portion of each shoe plate and extends to the floating roof. The individual shoe plates are held against the inside surface of the tank shell by a series of hangers 26. Typically, three hangers are used for each shoe plate. Each hanger generates sufficient force to ensure a minimum gap is maintained between the shoe plates and the tank shell over the full operating rim space range. Minimizing the gap is desirable for good product evaporative emission control.

Above the primary seal, multiple metal compression plates 27 are attached to a plate on the roof 12 to form a secondary seal. The compression plates are arranged in overlapping sequence to provide continuous coverage of the rim space 16. Sections of a tip seal 30 are secured to upper flanges on the compression plates, and bear against the tank shell. Individual electrical shunts 32 are installed as an extension of the compression plates 27 and are disposed at equal spacing around the floating-roof perimeter. The vertical clearance requirement 33 between the tip seal 30 and the top of the floating roof 12 represents lost storage capacity.

Figure 2:
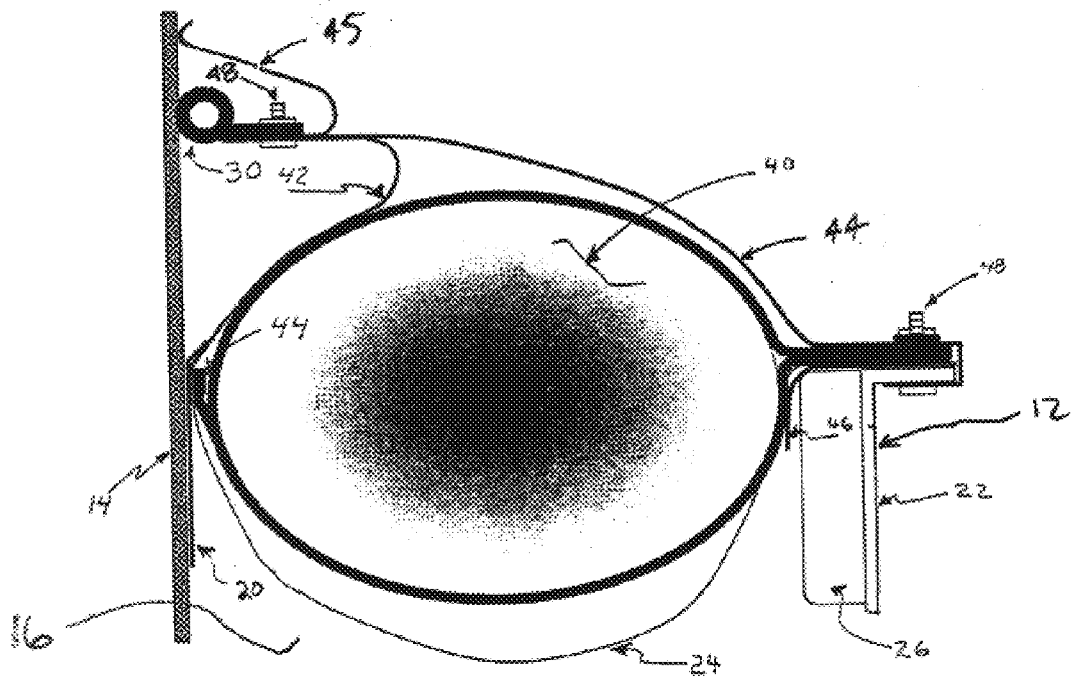
FIG. 2 is a partial cross-sectional view illustrating the use of a secondary seal in accordance with the present invention in a storage tank having an external floating roof.
Figure 3:
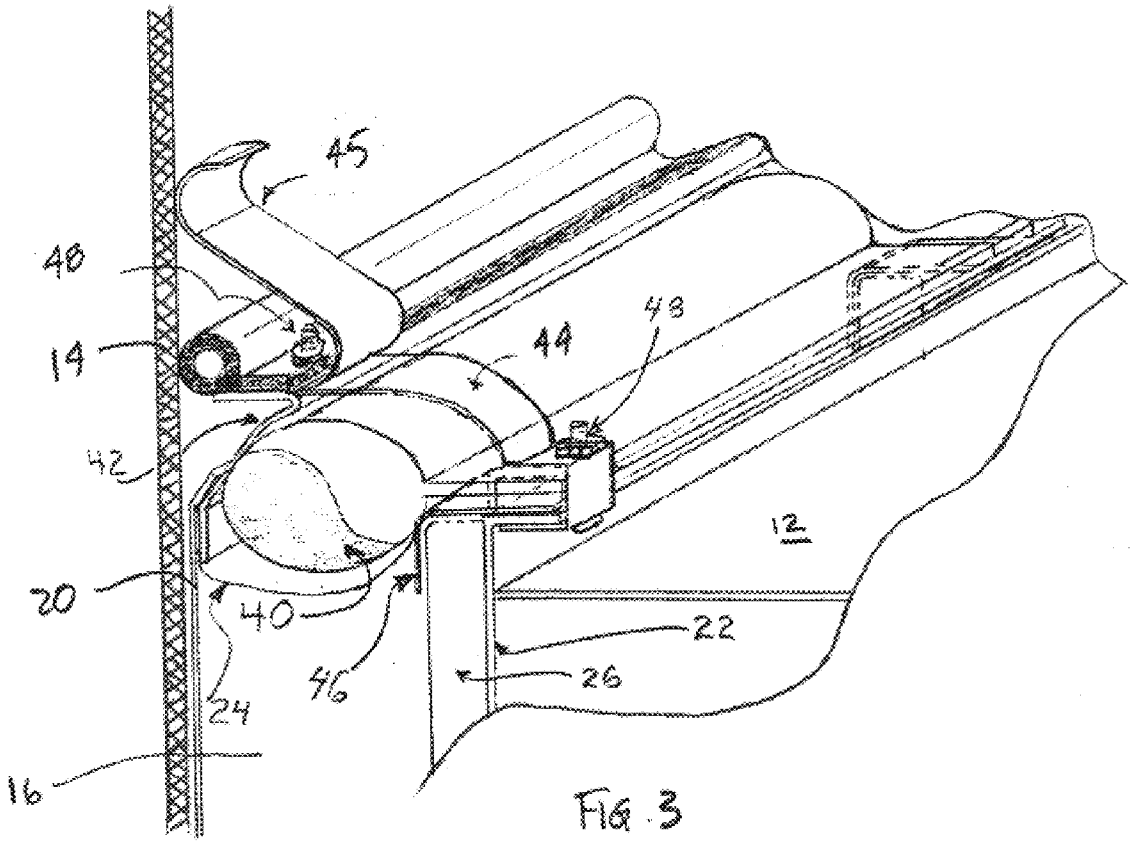
FIG. 3 is an orthogonal projection of the elements seen in FIG. 2.
Figure 4:
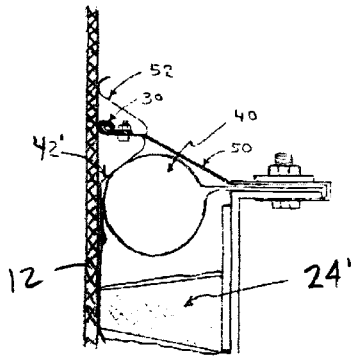
FIG. 4 is an elevational view of an alternate embodiment of a secondary seal in accordance with the present invention.

FIGS. 2 and 3 illustrate a storage tank in which a new, low-profile secondary seal 40 is used. The tank includes a primary seal 24 that seals the rim space 16 between the floating roof 12 and the tank shell 14. The primary seal can be of any conventional design, but should keep the rim space substantially closed over the full design operating range. As illustrated, the primary seal includes conventional shoe plates 20. Alternatively, a resilient foam- (or liquid-) filled primary seal 24' could be used as the primary seal, as seen in FIG. 4.

Figure 5:
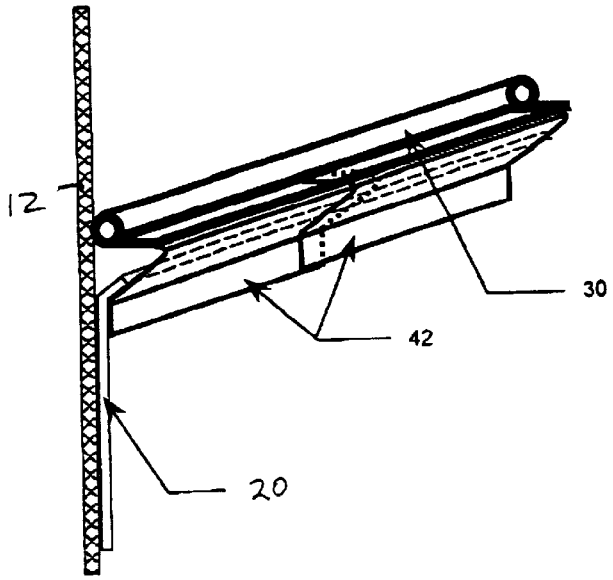
FIG. 5 is an enlarged, cross-sectional view of a portion of an alternate embodiment of the secondary seal.

In the embodiment of the invention seen in FIGS. 2 and 3, the secondary seal 40 includes a spacer in the form of multiple adapter plates 42 attached to the shoe plates 20. As illustrated, the adapter plates are attached to upper sections of the shoe plates and are set in a sequential and overlapped configuration, as seen in FIG. 5. The adapter plates that are illustrated in FIGS. 2 and 3 include a mounting flange that supports a tip seal 30 and an electrical shunt comprised of lower and upper shunt sections 44 and 45. The lower shunt section is attached to the floating roof; the upper shunt section is adapted to remain in contact with the tank shell. Together, the shunt sections provide electrical continuity between the tank shell 14 and the floating roof 12, reducing effects from lightening strikes. The plates, tip seal, and shunt sections can be held together by a bolt 48 and multiple clamp plates 50, seen in FIG. 6.

The tip seal 30 is seated against the tank shell 14 by pressure of a tube 40 on the adapter plates 42. The pressure of the tube on the adapter plates, or of the tube on the shoe plates 20, may also reduce the gap between the tank shell and the shoe plates, helping to reduce emissions.

Figure 7:
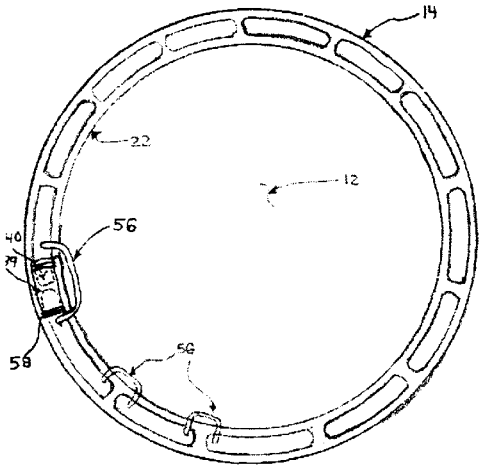
FIGS. 7 and 8 are plan views of alternative embodiments of secondary seals in accordance with the present invention.
Figure 8:
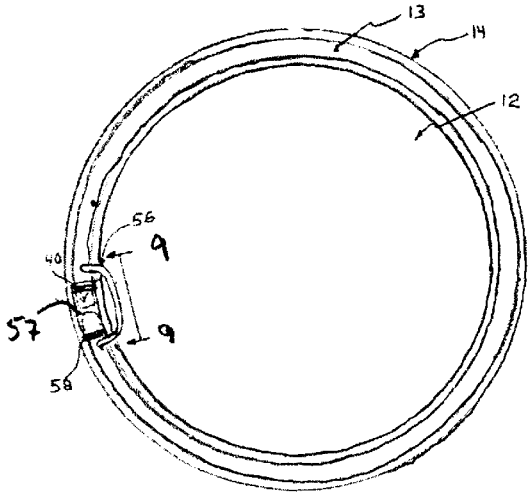
Figure 9:
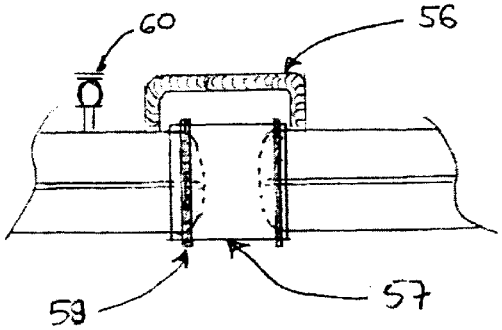
FIG. 9 is an enlarged, fragmentary side view of the seals seen in FIGS. 7 and 8.

The tube 40 is preferably made of a material that is weather-resistant and impermeable to vapors of the stored product. The material may be selected based on material durability, fire resistence, chemical resistence to the stored product, UV resistence, and local weather conditions. The tube may include a resilient foam core, may be liquid-filled or gel-filled, or may be inflated with air or an inert gas. It may have a continuous section around the circumference of the floating roof, or it may be composed of modular segments. It could, for example, consist of individual tube segments connected by a pressure-balancing connector 56, as seen in FIG. 7. As seen in FIGS. 7–9, continuity between ends of the tube or tube segments may be provided by a flexible fabric sleeve 57 held in place by mechanical clamps 58 at each end of the sleeve.

Figure 10:
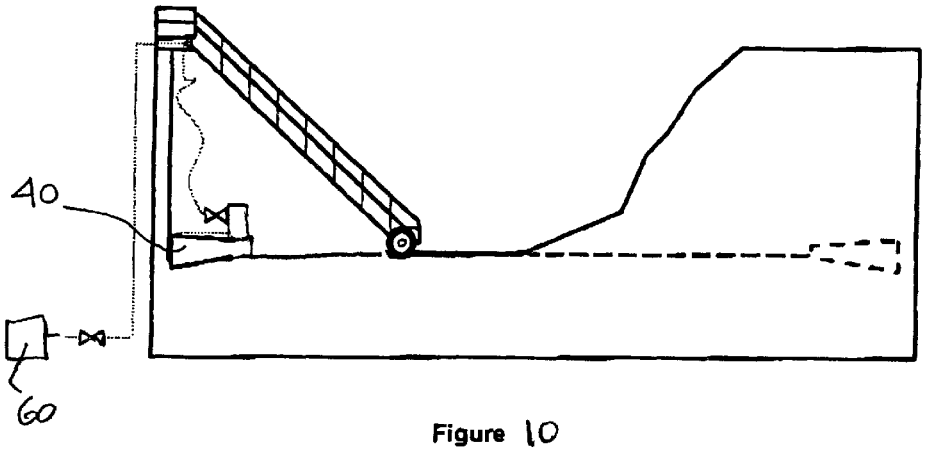
FIG. 10 is a fragmentary side view of a storage tank in which a secondary seal in accordance with the present invention is installed.

If the tube 40 is pressurized, the pressure may be monitored by locally-mounted pressure gage(s) (not shown). Alternatively, equipment may be added to provide for remote readout of the pressure. Low-pressure alarms may also be included to warn of a system problem or as indication of a serious rim fire condition. As seen in FIG. 10, supply 60 of make-up air (or inert gas) could be provided outside the floating roof tank while the tank is in product service. Make-up air (or inert gas) may be added manually or via an automated system.

Figure 11:
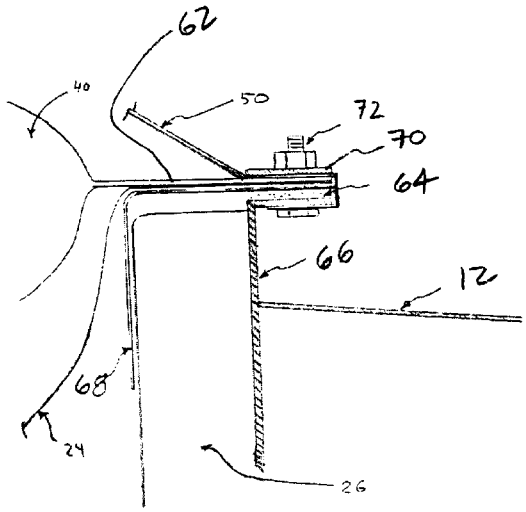
FIG. 11 is an enlarged view of a section of the secondary seal seen in FIG. 3.

The tube 40 need not extend all the way from the adapter plates 42 of the spacer to the floating roof 12. For example, a flexible flange 62 may extend from the tube to the roof. One example of the use of a flange is seen in FIG. 11. In that illustration, gasket tape 64 provides a vapor-tight joint at an upper flange of a rim plate 66 on the floating roof 12. It may be preferable to first install the gasket tape 64, then a primary hanger protective cover 68, then the primary seal 24, then the flexible flange on the tube, then the lower shunt section 50, and finally a rim clamp plate 70 secured in place by a bolt 72. Alternatively, these elements could be arranged vertically or at an angle rather than horizontally.

Figure 6:
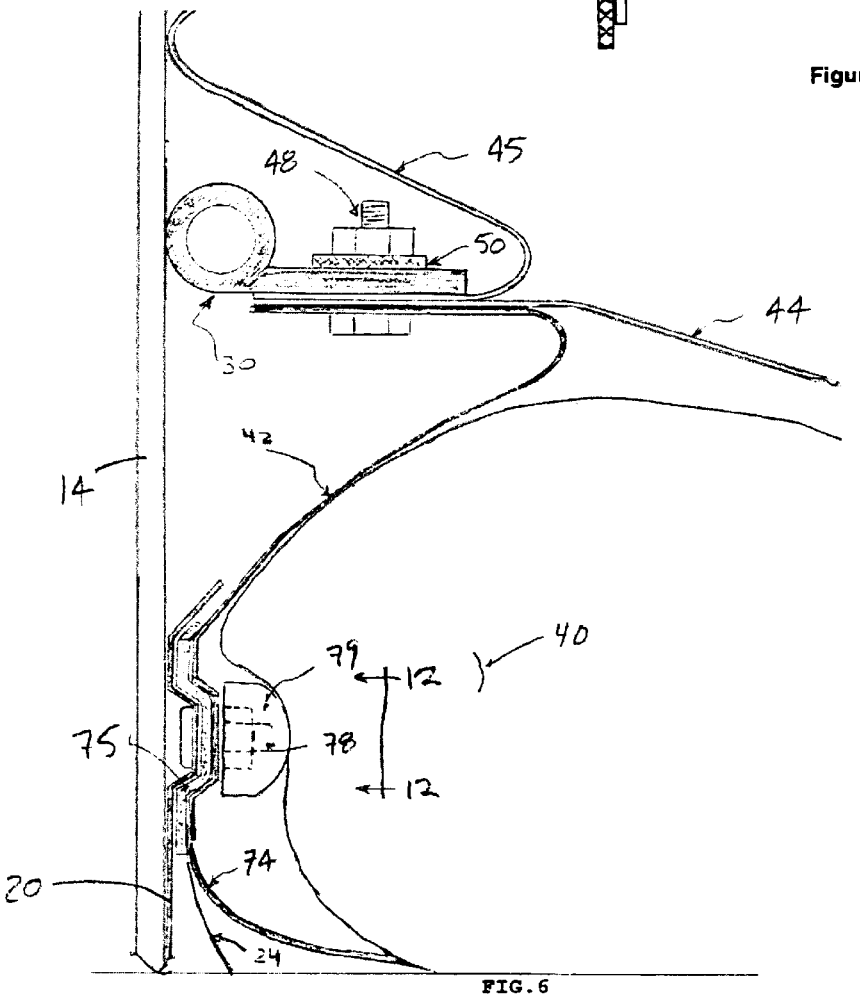
FIG. 6 is an enlarged sectional view of an alternative embodiment of the secondary seal seen in FIGS. 2 and 3.
Figure 12:
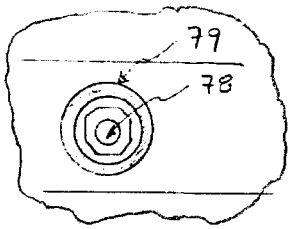
FIG. 12 is an end view of a portion of the secondary seal seen in FIG. 6.

FIG. 6 shows a preferred configuration of the connection of the tube 40 and the tip seal 30 with the shoe plates 20. In this illustration, the adapter plates 42 are secured to an upper portion of each shoe plate. A tube extension 74 on the tube secures the tube to the shoe plates, enabling the tube seal to be supported by the shoe plates. Gasket tape 75 protects the primary seal 24 and the tube extension. The adapter plates 42 are secured with a bolted connection 78 between the shoe plates and the tube. The bolted connection includes a protective access cover 79, better seen in FIG. 12, that provides access to the bolt yet can protect the tube as it rides against the upper portion of the shoe plates.

When a resilient foam-filled primary seal 24' is used, as shown in FIG. 4, a modified adapter plate 42' can be used to capture the primary seal and support the tip seal 30 above it. In this arrangement, the service life of the primary seal may be increased because the fabric is no longer in direct contact with the tank shell 12.

Figure 13:
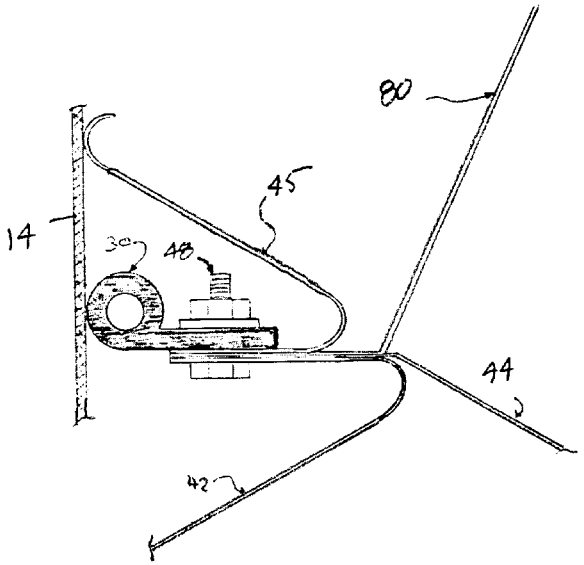
FIG. 13 is an enlarged, partial elevational view of an alternative embodiment of a secondary seal in accordance with the present invention.

FIG. 13 illustrates a tip seal 30 equipped with a product recovery trough 80. The properties of crude oil vary considerably depending on source and how long that source has been in production. Depending on the type of crude oil in storage, there may be a significant quantity of product that remains on the tank shell as the floating roof descends during product send-out operations. If left uncontrolled, residual product can flow over the secondary seal and onto the roof. To recover this product, multiple, overlapping sections can be secured to the adapter plates to form a product recovery trough 80. Gasket tape and either screws or clips may be used to provide an adequate seal between trough sections.

This detailed description has been given for clarity of understanding only. It is not intended and should not be construed as limiting the scope of the invention, which is defined in the following claims.

What is claimed is:

1. A secondary seal for a liquid storage tank having a floating roof and a primary seal connected to the floating roof and to a shoe plate adjacent a shell of the tank, the secondary seal comprising:

a tip seal adjacent the shell of the tank;

a spacer connecting the tip seal to the shoe plate; and a tube above the primary seal, connected to the floating roof and bearing on the spacer with sufficient force to maintain the tip seal in sealing engagement against the shell of the tank.

2. The secondary seal as recited in claim 1, in which the spacer is inwardly-projecting.

3. A secondary seal as recited in claim 1, in which the tip seal is no more than about twelve inches above the top of the floating roof.

4. A secondary seal as recited in claim 1, in which the tube is filled with resilient foam.

5. A secondary seal as recited in claim 1, in which the tube is filled with liquid .

6. A secondary seal as recited in claim 1, in which the tube is filled with gel.

7. A secondary seal as recited in claim 1, in which the tube is filled with a gas.

8. A secondary seal as recited in claim 1, in which the tube is filled with an inert gas.

9. A secondary seal as recited in claim 1, in which the tube has a continuous section around the circumference of the floating roof.

10. A secondary seal as recited in claim 1, in which the tube is modular around the circumference of the floating roof.

11. A secondary seal as recited in claim 1, in which the tube comprises individual tube segments connected by a pressure-balancing connector.

12. A secondary seal as recited in claim 1, in which the tube bears on the shoe plate.

13. A secondary seal as recited in claim 1, in which the tube is supported by the shoe plate.

14. A secondary seal as recited in claim 1, in which a tube extension on the tube secures the tube to the shoe plate.

15. A secondary seal as recited in claim 1, in which the spacer comprises a set of adapter plates installed in a sequential and overlapped configuration.

16. A secondary seal as recited in claim 1, and further comprising a bolted connection between the shoe plate and the tube, the bolted connection having a protective access cover.

17. A secondary seal as recited in claim 1, and further comprising an electrical shunt attached to the floating roof, supported by the tip seal, and adapted to remain in contact with the tank shell.

18. A secondary seal as recited in claim 1, and further comprising a primary hanger protective cover between the tube and the floating roof.

19. A liquid storage tank comprising:

a tank shell;

a floating roof within the shell;

a shoe plate adjacent the shell;

a primary seal connected to the floating roof and to the shoe plate; and a secondary seal comprising:

a tip seal adjacent the shell;

a spacer connecting the tip seal to the shoe plate; and a tube above the primary seal, connected to the floating roof and bearing on the spacer with sufficient force to maintain the tip seal in sealing engagement against the shell of the tank.

20. A method for installing a secondary seal in a liquid storage tank having a floating roof and a primary seal connected to the floating roof and to a shoe plate adjacent a shell of the tank, the method comprising:

installing a spacer connecting a tip seal to the shoe plate, the tip seal adjacent the shell of the tank;

installing a tube above the primary seal; and connecting the tube to the floating roof and causing the tube seal to bear on the spacer with sufficient force to maintain the tip seal in sealing engagement against the shell of the tank.

* * * * *